US010761550B2

(12) United States Patent
Sorace

(10) Patent No.: US 10,761,550 B2
(45) Date of Patent: Sep. 1, 2020

(54) CURRENT LIMITATION FOR VOLTAGE REGULATOR

(71) Applicant: NXP B.V., Eindhoven (NL)

(72) Inventor: Christian Vincent Sorace, Falicon (FR)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/449,893

(22) Filed: Jun. 24, 2019

(65) Prior Publication Data

US 2020/0004283 A1 Jan. 2, 2020

(30) Foreign Application Priority Data

Jul. 2, 2018 (EP) ..... 18305859

(51) Int. Cl.
*G05F 1/573* (2006.01)
*G05F 1/46* (2006.01)
*G05F 1/575* (2006.01)

(52) U.S. Cl.
CPC ..... *G05F 1/573* (2013.01); *G05F 1/468* (2013.01); *G05F 1/575* (2013.01)

(58) Field of Classification Search
CPC ..... G05F 1/573; G05F 1/575; G05F 1/468
See application file for complete search history.

(56) References Cited

U.S. PATENT DOCUMENTS 6,407,537 B2 * 6/2002 Antheunis ..... G05F 3/247 323/312
6,977,491 B1 12/2005 Caldwell et al.
7,224,155 B2 5/2007 Bo et al.
2006/0208717 A1 * 9/2006 Shimizu ..... H02M 3/157 323/284
2006/0290333 A1 * 12/2006 Fukushi ..... H02M 1/32 323/277
2008/0165465 A1 * 7/2008 Rallabandi ..... G05F 1/573 361/93.9
2010/0052636 A1 3/2010 Takagi et al.
2012/0169303 A1 * 7/2012 Chen ..... G05F 1/573 323/265
2012/0187930 A1 * 7/2012 Williams ..... G05F 1/5735 323/273
2014/0253079 A1 * 9/2014 Ding ..... H02M 3/156 323/283

* cited by examiner

*Primary Examiner* — Emily P Pham
(74) *Attorney, Agent, or Firm* — Charlene R. Jacobsen

(57) ABSTRACT

This specification discloses methods and devices for limiting output current of a voltage regulator, in order to protect the voltage regulator against component overstress in case of output load current overloading. In some embodiments, a current limitation circuit acting on a reference input voltage of a voltage regulator can limit the maximum output load current of the voltage regulator. Once the current limitation circuit detects an over current load, the reference voltage is adjusted or decreased to limit the maximum output load current. Additionally, these methods and devices can be coupled easily with a slew rate control circuit to also limit the inrush current.

15 Claims, 11 Drawing Sheets

500

CURRENT LIMITATION FOR VOLTAGE REGULATOR

CROSS-REFERENCE TO RELATED APPLICATIONS

This application claims the priority under 35 U.S.C. § 119 of European patent application no. 18305859.3, filed Jul. 2, 2018, the contents of which are incorporated by reference herein.

FIELD

The described embodiments relate generally to methods and devices that provide for current limitation, and more particularly to methods and devices that provide for current limitation for voltage regulation.

BACKGROUND

Current limitation circuits can be used to protect voltage regulator against component overstress in case of output load current overloading. However, typical current limitation circuits can have instability and other issues.

Therefore, there are strong motivations for improving current limitation circuits, and mitigating instability and other issues.

SUMMARY

Typically, current limitation circuits can sense the output current and counter react on the main amplification stage to alter the characteristics of the amplifier of the voltage regulator. However, such method can have the disadvantage of modifying the loop response, and may cause instability issues. This specification discloses methods and systems for limiting output current of a voltage regulator, which can solve potential stability issues during regulator power up or current limitation use cases, as well as provide for other benefits. In some embodiments, this specification describes current limitation circuits that can limit the maximum output load current by acting on the reference input voltage of the regulator. Once the current limitation detects an over current load, the reference voltage is adjusted (or, for example, decreased) to limit the output load current.

Such embodiments can be used to manage the current limitation in case of output load current overloading to protect the regulator and to not overstress regulator components. These embodiments limit the current in case of output load current overloading by presenting a current limitation loop outside the regulator feedback loop. In turn, this current limitation loop can take over from the regulator feedback in case of output load current overloading. This can solve potential stability issues during regulator power up or current limitation use cases. It also simplifies the overall regulator stability analysis as the current limit loop is outside the regulator feedback loop.

The present invention provides for a device comprising: (a) a voltage regulator, the voltage regulator configured to output a regulated output voltage; (b) a reference voltage module, the reference voltage module configured to output a reference voltage to the voltage regulator; (c) a current sensor and comparator, the current sensor and comparator configured to sense an output current of the voltage regulator; (d) a controller for current limitation, (e) wherein the controller is configured to limit the output current of the voltage regulator in response to an output of the current sensor and comparator by adjusting the reference voltage from the reference voltage module.

In some embodiments, the current sensor and comparator is further configured to compare the output current of the voltage regulator with a reference current to activate the current limitation.

In some embodiments, the controller is further configured to limit the output current of the voltage regulator in response to the output of the current sensor and comparator indicating an overload by adjusting the reference voltage from the reference voltage module.

In some embodiments, the voltage regulator is comprising of: (a) an error amplifier, (b) a voltage conversion stage, (c) a feedback circuit, (d) wherein the error amplifier is configured to receive input from both the reference voltage module and the feedback circuit, and to provide output to the voltage conversion stage, (e) wherein the voltage conversion stage is configured to receive input from the error amplifier and to provide voltage regulator output voltage to the feedback circuit, (0 wherein the current sensor and comparator is further configured to generate a copy of the voltage regulator output current.

In some embodiments, the voltage conversion stage is comprising of: an output power stage driven by an output power stage controller.

In some embodiments, the output power stage controller is a linear controller or a switching controller.

In some embodiments, the feedback circuit is a voltage control circuit or a current control circuit.

In some embodiments, the reference voltage module further comprises a slew rate control, wherein the slew rate control is coupled to the voltage regulator, wherein the slew rate control limits an inrush current of the voltage regulator by controlling a slope of variation of an input to the voltage regulator.

In some embodiments, the controller is further configured to limit the output current of the voltage regulator by adjusting an output voltage of the slew rate control.

In some embodiments, the reference voltage module is able to concurrently provide a normal operational reference voltage that is not adjusted by the controller for current limitation to another voltage regulator.

The present invention also provides for a method for limiting output current of a voltage regulator, the method comprising: (a) a reference voltage module inputting a reference voltage to a voltage regulator; (b) the voltage regulator outputting a regulated output voltage and an output current, wherein the output voltage is based on the input reference voltage; (c) a current sensor and comparator sensing the output current of the voltage regulator; (d) a controller limiting the output current of the voltage regulator, (e) wherein the controller limits the output current of the voltage regulator in response to an output of the current sensor and comparator by adjusting the reference voltage from the reference voltage module.

In some embodiments, the method further comprising: the current sensor and comparator comparing the output current of the voltage regulator with a reference current to activate the output current limitation by the controller.

In some embodiments, the step of the voltage regulator outputting an output voltage and an output current is comprising of: (a) an error amplifier receiving input from both the reference voltage module and a feedback circuit, (b) the error amplifier providing output to a voltage conversion stage, (c) the voltage conversion stage providing voltage regulator output voltage to the feedback circuit, (d) the voltage conversion stage providing voltage regulator output current to the current sensor and comparator.

In some embodiments, the reference voltage module further comprises a slew rate control, wherein the slew rate control is coupled to the voltage regulator, wherein the slew rate control limits an inrush current of the voltage regulator by controlling a slope of variation of an input to the voltage regulator.

In some embodiments, the controller further limits the output current of the voltage regulator by adjusting an output voltage of the slew rate control.

The present invention provides for a computer program product comprising executable instructions encoded in a non-transitory computer readable medium which, when executed by a system, carry out or control the following method for limiting output current of a voltage regulator, the method comprising: (a) a reference voltage module inputting a reference voltage to a voltage regulator; (b) the voltage regulator outputting a regulated output voltage and an output current, wherein the output voltage is based on the input reference voltage; (c) a current sensor and comparator sensing the output current of the voltage regulator; (d) a controller limiting the output current of the voltage regulator, (e) wherein the controller limits the output current of the voltage regulator in response to an output of the current sensor and comparator by adjusting the reference voltage from the reference voltage module.

The above summary is not intended to represent every example embodiment within the scope of the current or future Claim sets. Additional example embodiments are discussed within the Figures and Detailed Description below. Other aspects and advantages of embodiments of the present invention will become apparent from the following detailed description taken in conjunction with the accompanying drawings.

DETAILED DESCRIPTION

Figure 1:
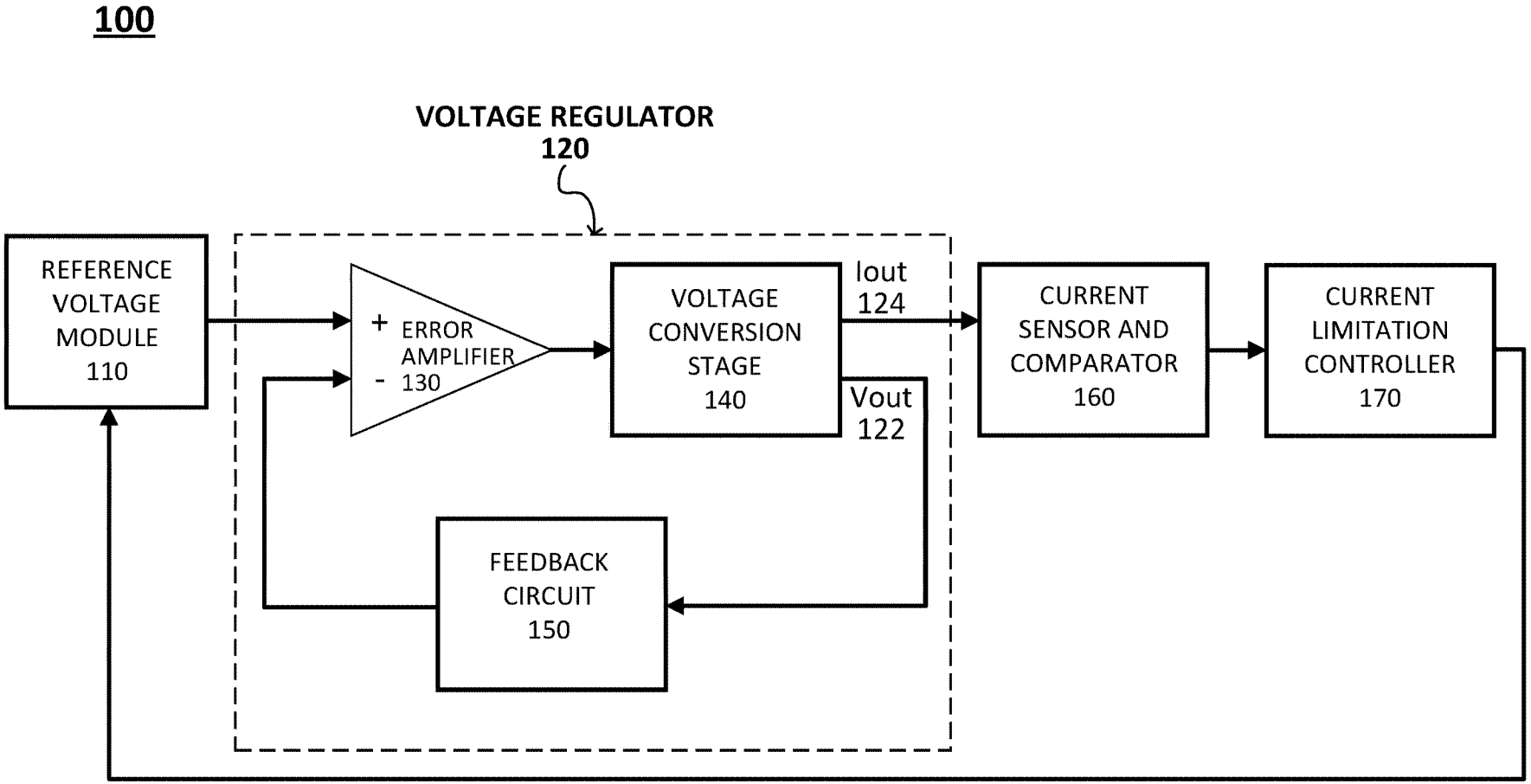
FIG. 1 shows a functional block diagram of a first device for limiting output current of a voltage regulator in accordance with some embodiments of the invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

This specification discloses methods and systems for limiting output current of a voltage regulator. In some embodiments, this specification describes current limitation circuits used for voltage regulator. Current limitation circuits are used to protect regulator against component overstress in case of output load current overloading. In some embodiments, current limitation circuits can limit the maximum output load current by acting on the reference input voltage of the regulator. Once the current limitation detects an over current load, the reference voltage is decreased to limit the output load current. Therefore, in some embodiments, a current limitation circuit acting on the reference voltage input of a voltage regulator can limit the maximum output load current of the voltage regulator.

In some embodiments, this specification describes methods and devices to manage the current limitation and limit the maximum output load current. This helps to protect the regulator, by acting on the reference input voltage instead of directly on the regulator output power stage. In case of output load current overloading, the current limitation decreases the reference input voltage of the regulator. This does not overstress the regulator components because the current limitation is achieved through the reference input voltage. This also does not impact the reference voltage module performance. As an example, there is no additional serial components on the reference voltage path and it is not loading current on the reference voltage during normal operation. Additionally, these methods and devices can be coupled easily with a slew rate control circuit to also limit the inrush current.

In some embodiments, this specification describes methods and devices that allow a simplest stability analysis because:

a. the current limitation takes over from the regulator feedback loop through the reference input voltage;

b. the current limitation loop is outside the regulator feedback loop;

c. the current limitation loop does not need a lot of gain to limit the maximum output load current of the regulator;

d. there is no conflict between the current limitation loop and the regulator feedback loop in term of stability.

Usually, there are issues in term of current limitation stability during regulator power up due to conflict with the regulator main loop. By placing the current limitation loop outside the regulator feedback loop, this problem is now overcome.

In some embodiments, this specification describes methods and devices that avoids overstress on regulator component during the current limitation as it will bias the whole regulator smoothly according the reference input voltage value.

FIG. 1 shows a functional block diagram of a first device 100 for limiting output current of a voltage regulator in accordance with some embodiments of the invention. FIG. 1 shows the current limitation controller 170 having a feedback to the reference voltage module 110. In case of output load current (Iout 124) overloading, the current limitation is activated by decreasing the reference voltage input of the voltage regulator 120. In term of functionality, it can be noticed that the current limitation loop is outside the regulator feedback loop. In some embodiments, once an overload on the output load current (Iout 124) is detected by the current limitation, the reference voltage can be adjusted or decreased to limit the maximum output load current.

In FIG. 1, a first device 100 for limiting output current of a voltage regulator includes a reference voltage module 110, a voltage regulator 120, a current sensor and comparator 160, and a current limitation controller 170. The reference voltage module 110 is configured to input a reference voltage to the voltage regulator 120. For example, the reference voltage module 110 can include a reference voltage, bandgap, buffer, etc. The voltage regulator 120 is configured to output a regulated output voltage. The voltage regulator outputs an output voltage (Vout 122) and an output current (Iout 124), wherein the output voltage is based on the input reference voltage. The current sensor and comparator 160 is configured to sense an output current (Iout 124) of the voltage regulator 120.

The current limitation controller 170 is a controller for limiting the output current (Iout 124). In some embodiments, the current limitation controller 170 is a circuit which acts on the reference voltage input to limit the maximum output load current. The controller 170 is configured to limit the output current (Iout 124) of the voltage regulator 120 in response to an output of the current sensor and comparator 160 by adjusting the reference voltage from the reference voltage module 110. In some embodiment, the current sensor and comparator 160 is further configured to compare the output current (Iout 124) of the voltage regulator 120 with a reference current to activate the current limitation. In some embodiments, the controller 170 is further configured to limit the output current (Iout 124) of the voltage regulator 120 in response to the output of the current sensor and comparator 160 indicating an overload by adjusting the reference voltage from the reference voltage module 110. In some embodiments, the controller 170 is further configured to limit the output current (Iout 124) of the voltage regulator 120 in response to the output of the current sensor and comparator 160 indicating an overload by decreasing the reference voltage from the reference voltage module 110.

The voltage regulator 120 includes an error amplifier 130, a voltage conversion stage 140, and a feedback circuit 150. The error amplifier 130 is configured to receive input from both the reference voltage module 110 and the feedback circuit 150, and to provide output to the voltage conversion stage 140. The voltage conversion stage 140 is configured to receive input from the error amplifier 130 and to provide voltage regulator output voltage (Vout 122) to the feedback circuit 150. The current sensor and comparator 170 is further configured to generate a copy of the voltage regulator output current (Iout 124).

In some embodiments, the voltage conversion stage 140 includes an output power stage driven by an output power stage controller. In some embodiments, the output power stage controller is a linear controller or a switching controller. In some embodiments, the feedback circuit is a voltage control circuit or a current control circuit. In some embodiments, the switching controller is a PWM (pulse width modulation) controller or a PFM (pulse frequency modulation) controller.

Figure 2A:
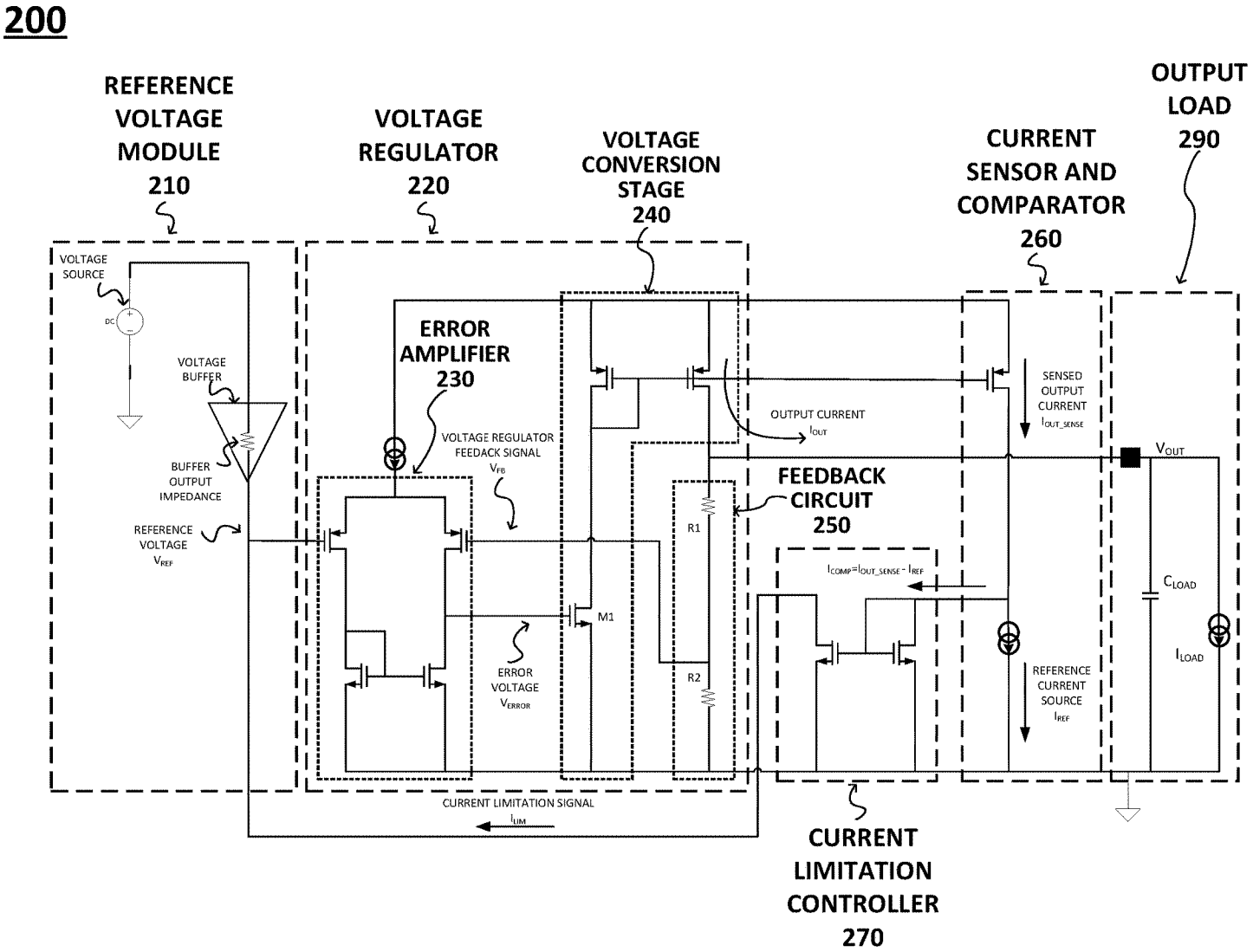
FIG. 2A shows a circuit diagram of the FIG. 1 device in accordance with some embodiments of the invention.

FIG. 2A shows a circuit diagram of the FIG. 1 device in accordance with some embodiments of the invention. In particular, FIG. 2A is showing one example embodiment of a circuit implementation of the FIG. 1 device 100. Therefore, one skilled in the relevant art will recognize, in light of the description of FIG. 2A, that the invention can be practiced with other embodiments of a circuit implementation of the FIG. 1 device 100, and these other embodiments are not shown in this specification.

In FIG. 2A, a circuit 200 for limiting output current of a voltage regulator includes a reference voltage module 210, a voltage regulator 220, a current sensor and comparator 260, and a current limitation controller 270. The reference voltage module 210 is configured to input a reference voltage to the voltage regulator 220. FIG. 2A further shows that the voltage regulator 220 includes an error amplifier 230, a voltage conversion stage 240, and a feedback circuit 250. FIG. 2A also shows an output load 290.

As an example, the voltage conversion stage 240 shown in FIG. 2A is a linear controller, but, in other embodiments, other types of controller can be implemented.

Being an example implementation of device 100, circuit 200 operates in a manner similar to device 100. Therefore, for example, FIG. 2A shows the current limitation controller 270 having a feedback to the reference voltage module 210. In case of output load current overloading, the current limitation is activated by decreasing the reference voltage input of the voltage regulator 220. In term of functionality, it can be noticed that the current limitation loop is outside the regulator feedback loop. In some embodiments, once an overload on the output load current is detected by the current limitation, the reference voltage can be adjusted or decreased to limit the output load current.

Again, similarly, the reference voltage module 210 is configured to input a reference voltage to the voltage regulator 220. The voltage regulator 220 is configured to output a regulated output voltage. The voltage regulator outputs an output voltage and an output current, wherein the output voltage is based on the input reference voltage. The current sensor and comparator 260 is configured to sense an output current of the voltage regulator 220. The current limitation controller 270 is a controller for limiting the output current. In some embodiments, the current limitation controller 270 is a circuit which acts on the reference voltage input to limit the maximum output load current. The controller 270 is configured to limit the output current of the voltage regulator 220 in response to an output of the current sensor and comparator 260 by adjusting the reference voltage from the reference voltage module 210.

Figure 2B:
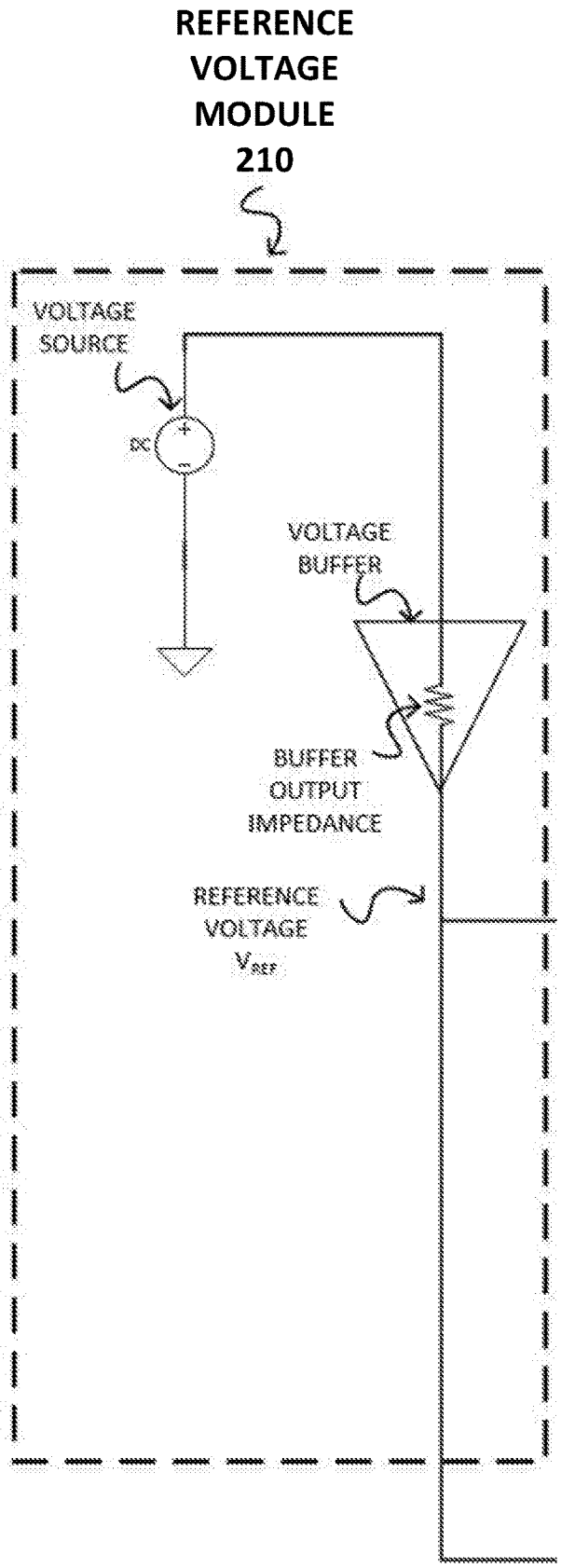
FIG. 2B shows a circuit diagram of a reference voltage module (which is part of the FIG. 2A device) in accordance with some embodiments of the invention.
Figure 2C:
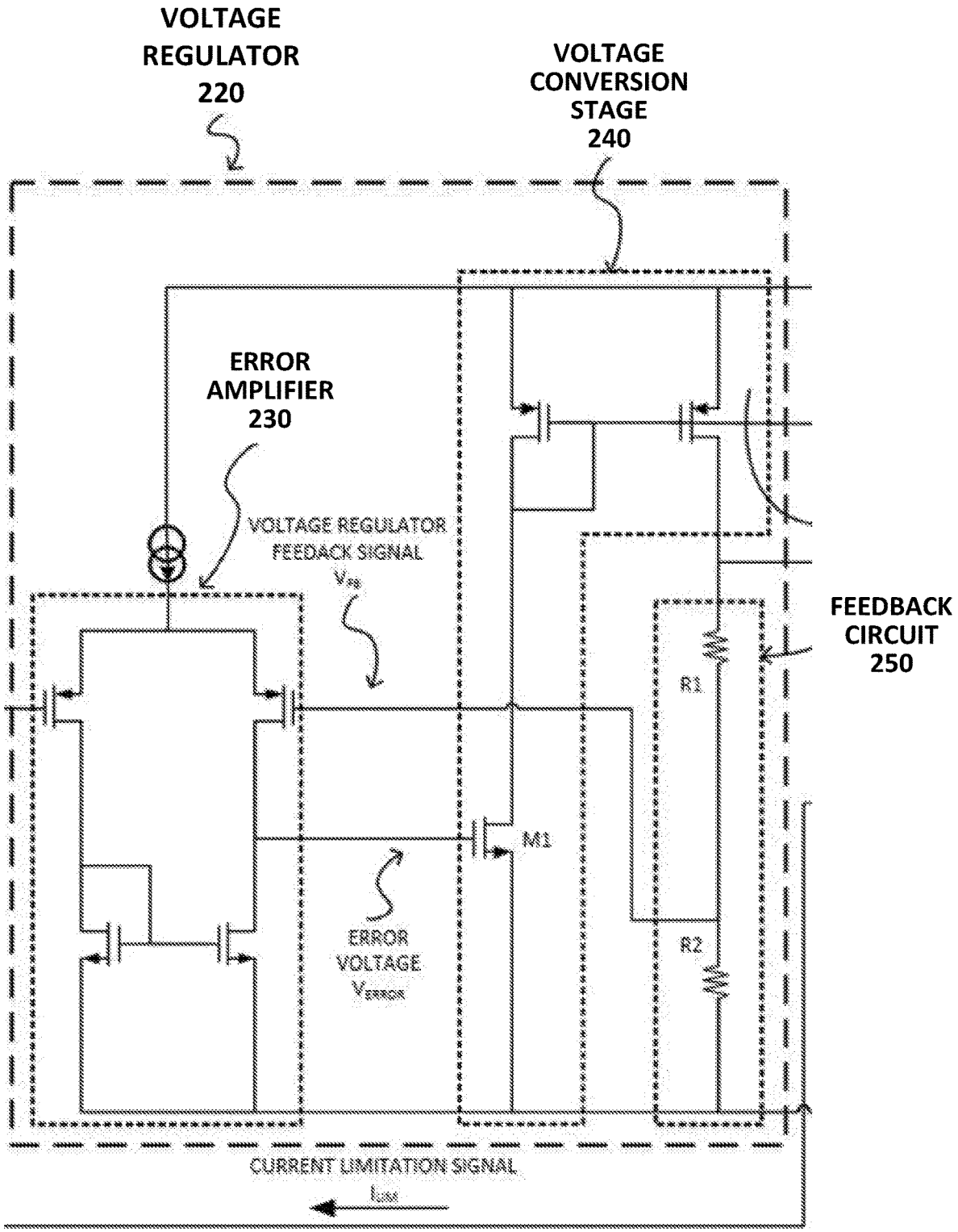
FIG. 2C shows a circuit diagram of a voltage regulator (which is part of the FIG. 2A device) in accordance with some embodiments of the invention.
Figure 2D:
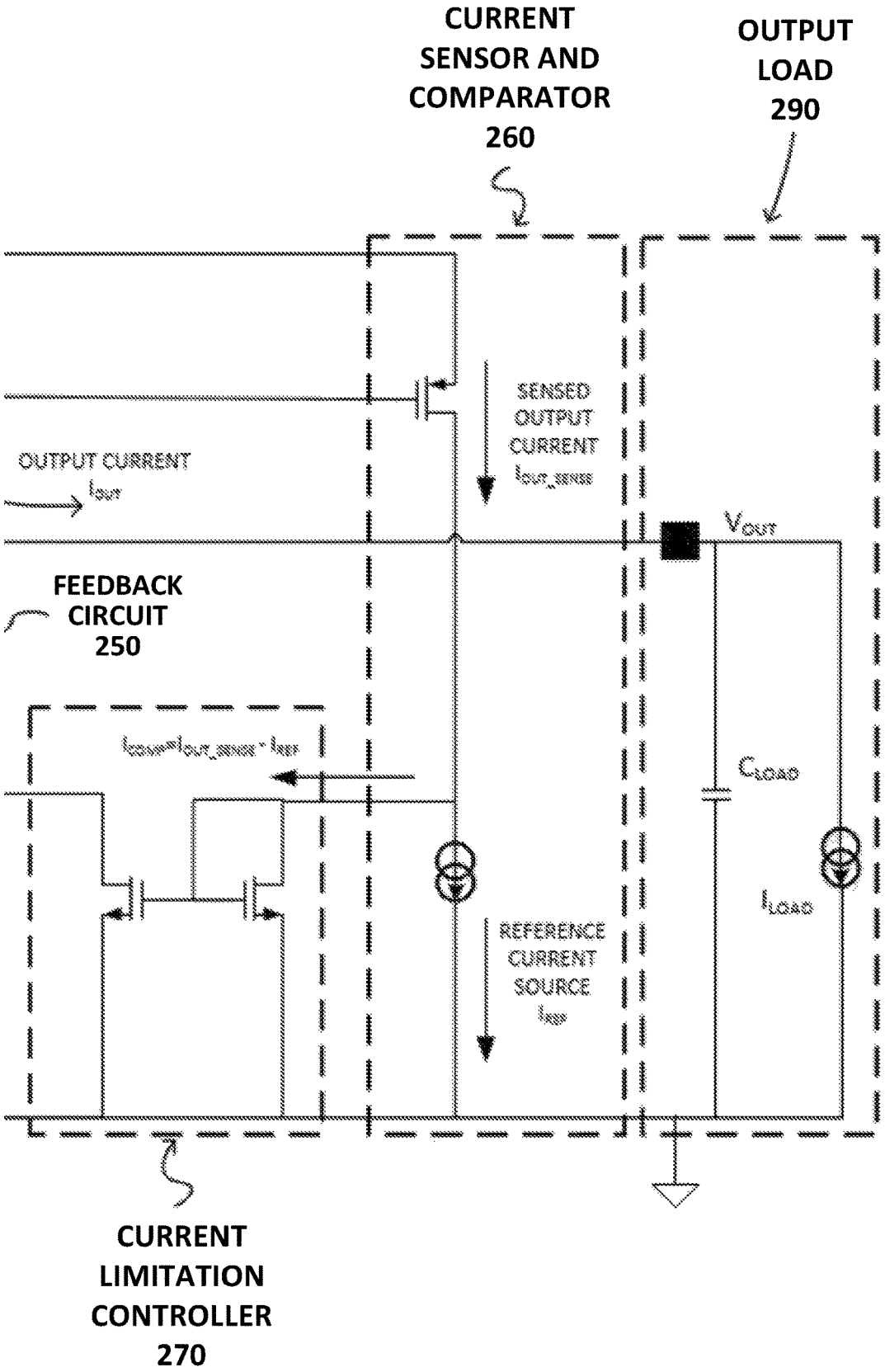
FIG. 2D shows a circuit diagram of a current limitation controller and a current sensor and comparator (which are part of the FIG. 2A device) and an output load in accordance with some embodiments of the invention.

FIG. 2A shows an overview of circuit 200, while FIGS. 2B, 2C, and 2D give the close-up views of various parts of circuit 200. In particular, FIG. 2B is showing the close-up view of the reference voltage module 210 in accordance with some embodiments of the invention. FIG. 2C is showing the close-up view of the voltage regulator 220 in accordance with some embodiments of the invention. FIG. 2D is showing the close-up view of the current limitation controller 270, the current sensor and comparator 260, and the output load 290 in accordance with some embodiments of the invention.

As shown in FIGS. 2A and 2C, the voltage regulator 220 is a classical LDO (low-dropout) regulator with feedback loop. The feedback voltage VFB is equal to VOUT*R2/(R2+R1). If VOUT is too low (VREF>VFB), then VERROR, output of the error amplifier and gate voltage of M1, increases and IOUT increases. The amount of output current IOUT is proportional to the difference between VREF and VFB. In case VOUT remains low for a long time due to a high load current, output short circuit or at start-up where the output starts from GND, the output current can be very high. A copy of IOUT, IOUT_SENSE, is generated and compared with IREF. As shown in FIGS. 2A and 2D, the difference in current, ICOMP=IOUT_SENSE−IREF, is fed to the current limitation controller 270, as long as the Sensed Output Current IOUT_SENSE>IREF (the current limitation controller 270 is built with NMOS which can generate a current in one direction only). As shown in FIGS. 2A, 2B, 2C, and 2D: if the latter is true (IOUT_SENSE>IREF) then Current Limitation Signal ILIM is generated by the current limitation controller 270 and fed to the node VREF. Due to the output impedance of the voltage buffer of the reference voltage module 210, VREF drops as soon as ILIM is outputted. The higher ILIM (i.e. the higher IOUT), the lower VREF becomes. The drop of VREF decreases the difference between VREF and VFB thus limits IOUT.

Figure 3:
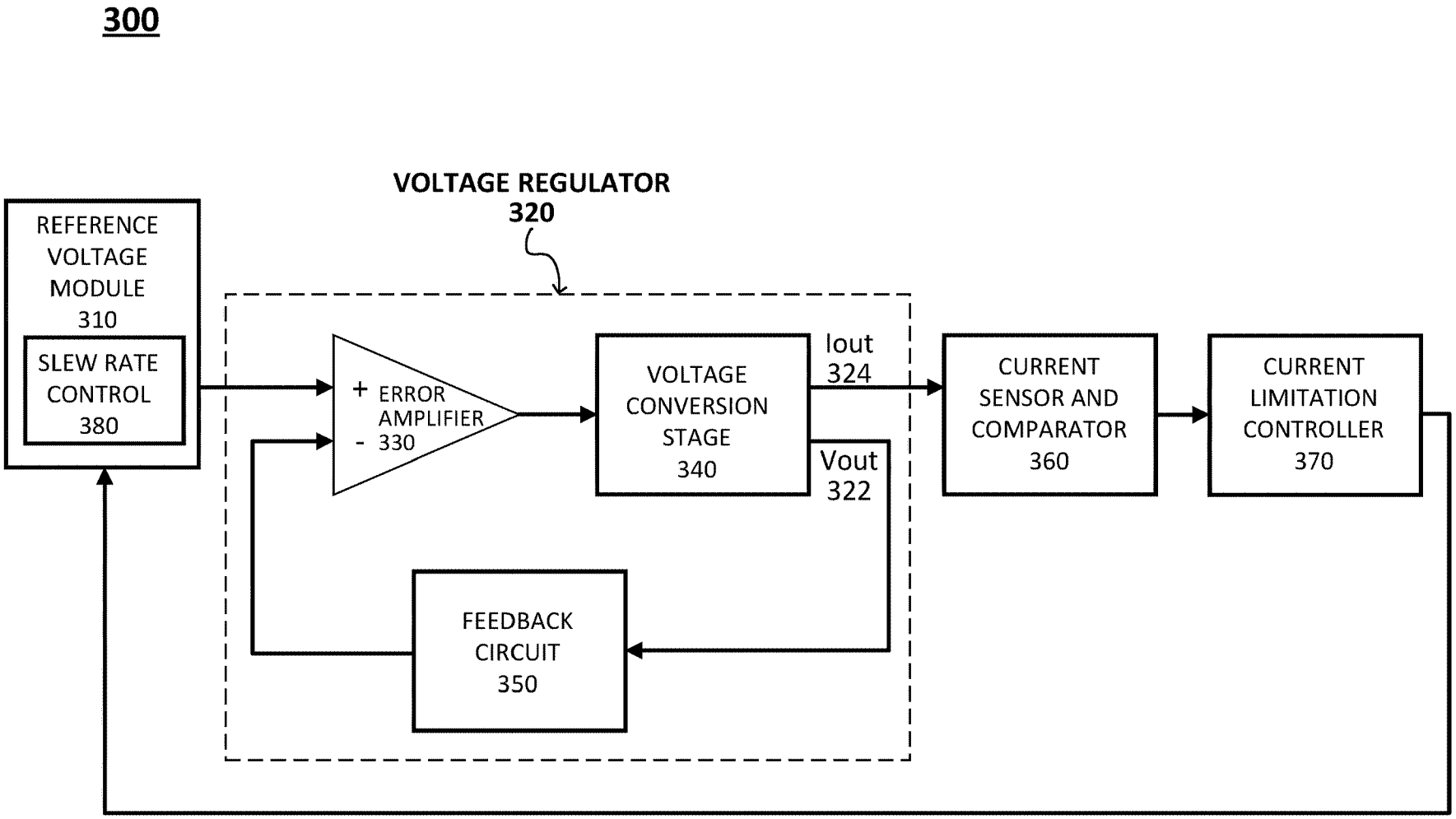
FIG. 3 shows a functional block diagram of a second device (which further includes a slew rate control) for limiting output current of a voltage regulator in accordance with some embodiments of the invention.

FIG. 3 shows a functional block diagram of a second device 300 (which further includes a slew rate control 380) for limiting output current of a voltage regulator in accordance with some embodiments of the invention. In FIG. 3, the second device 300 for limiting output current of a voltage regulator includes a reference voltage module 310, a voltage regulator 320, a current sensor and comparator 360, and a current limitation controller 370. FIG. 3 also shows that the voltage regulator 320 includes an error amplifier 330, a voltage conversion stage 340, and a feedback circuit 350. FIG. 3 shows that slew rate control 380 is included in reference voltage module 310. But, in some embodiments, the slew rate control can be separate from the reference voltage module (Note: not shown in FIG. 3). In some embodiments, the slew rate control 380 can be arranged to be positioned between the reference voltage module 310 and the voltage regulator 320 (Note: not shown in FIG. 3). In some embodiments, the reference voltage module 310 can be arranged to be positioned between the slew rate control 380 and the voltage regulator 320 (Note: not shown in FIG. 3). In some embodiments, the slew rate control 380 and the reference voltage module 310 can have a joint output into the voltage regulator 320. In some embodiments, the slew rate control and the reference voltage module can have separate outputs into the voltage regulator.

FIG. 3 is very similar to FIG. 1, except the second device 300 further includes a slew rate control 380 for limiting output current of a voltage regulator. The addition of a slew rate control is to limit an inrush current of the voltage regulator by controlling a slope of variation of an input to the voltage regulator at start-up. Slew rate is defined as the change of voltage or current per unit of time. Therefore, the slew rate control 380 can limit an inrush current of the voltage regulator 320 by controlling a slope of variation of an input (such as voltage) to the voltage regulator. For example, in some embodiments, the slew rate control can limit an inrush current of the voltage regulator by reducing the slope of variation of an input voltage to the voltage regulator.

In some embodiments, the reference voltage module 310 further comprises a slew rate control 380, wherein the slew rate control 380 is coupled to the voltage regulator 320, wherein the slew rate control 380 limits an inrush current of the voltage regulator 320 by controlling a slope of variation of an input to the voltage regulator 320.

In some embodiments, the controller 370 is further configured to limit the output current (Iout 324) of the voltage regulator 320 by adjusting an output voltage of the slew rate control. In some embodiments, the controller 370 can adjust an output voltage of the slew rate control, so that the voltage regulator 320 receives an "adjusted" reference voltage, and the output current (Iout 324) of the voltage regulator 320 is adjusted accordingly.

In some embodiments, the reference voltage module 310 is able to concurrently provide a normal operational reference voltage that is not adjusted by the current limitation controller 370 to another voltage regulator. This can mean that, in some embodiments, the reference voltage module 310 is coupled to both the voltage regulator 320 and another voltage regulator. Then the current limitation controller 370 can adjust an output voltage of the slew rate control, so that the voltage regulator 320 receives an "adjusted" reference voltage, while another voltage regulator receives an "unadjusted" reference voltage (which, in turn, can be considered to be a normal operational reference voltage that is not adjusted by the current limitation controller 370).

Figure 4A:
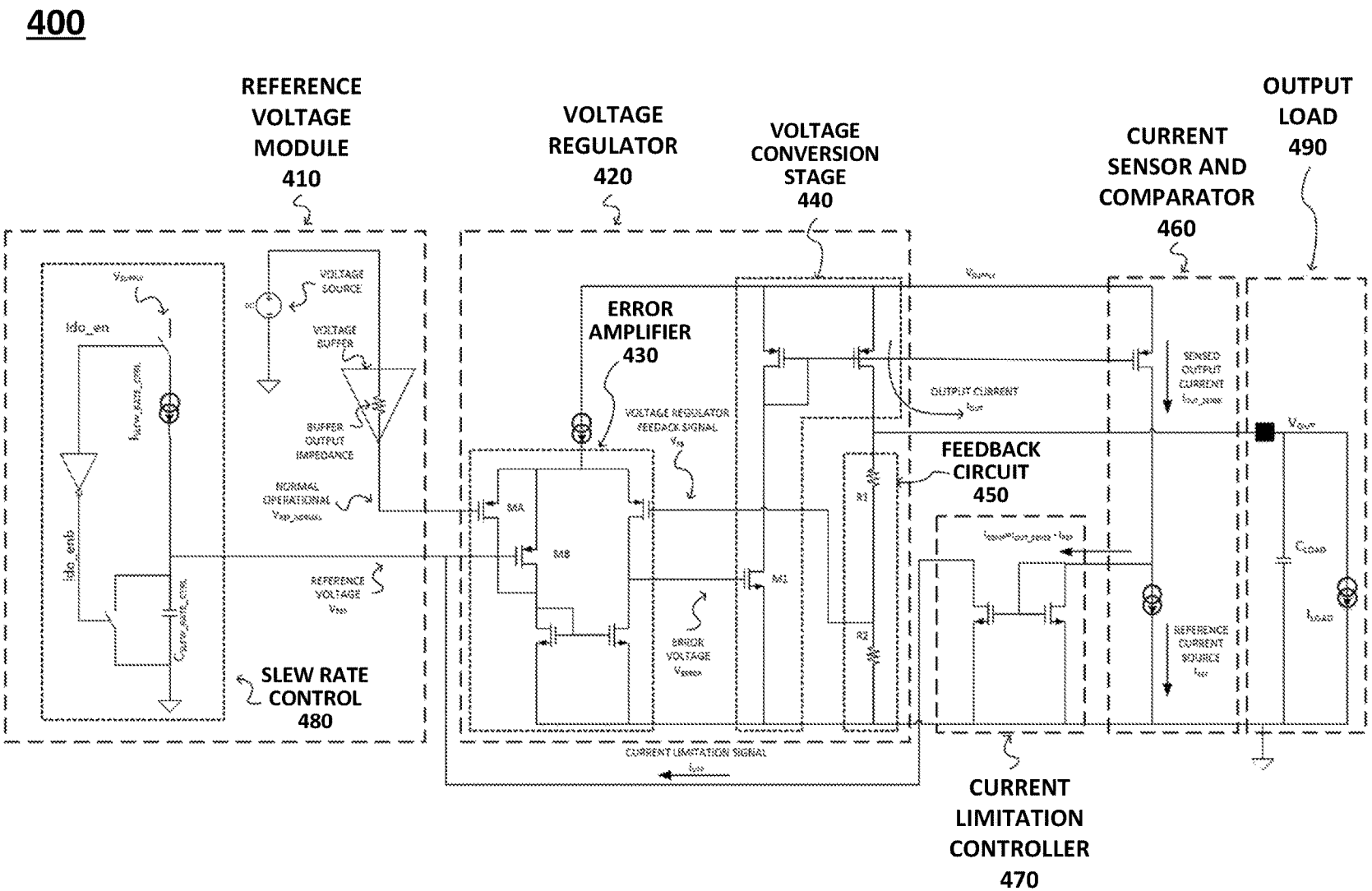
FIG. 4A shows a circuit diagram of the FIG. 3 device in accordance with some embodiments of the invention.

FIG. 4A shows a circuit diagram of the FIG. 3 device in accordance with some embodiments of the invention. In particular, FIG. 4A is showing one example embodiment of a circuit implementation of the FIG. 3 device 300. Therefore, one skilled in the relevant art will recognize, in light of the description of FIG. 4A, that the invention can be practiced with other embodiments of a circuit implementation of the FIG. 3 device 300, and these other embodiments are not shown in this specification.

In FIG. 4A, a circuit 400 for limiting output current of a voltage regulator includes a reference voltage module 410, a voltage regulator 420, a current sensor and comparator 460, a current limitation controller 470, and a slew rate control 480. The reference voltage module 410 is configured to input a reference voltage to the voltage regulator 420. FIG. 4A further shows that the voltage regulator 420 includes an error amplifier 430, a voltage conversion stage 440, and a feedback circuit 450. FIG. 4A also shows an output load 490.

Being an example implementation of device 300, circuit 400 operates in a manner similar to device 300. Therefore, for example, FIG. 4A shows the current limitation controller 470 having a feedback to the reference voltage module 410. In case of output load current overloading, the current limitation is activated by decreasing the reference voltage input of the voltage regulator 420. In term of functionality, it can be noticed that the current limitation loop is outside the regulator feedback loop. In some embodiments, once an overload on the output load current is detected by the current limitation, the reference voltage can be adjusted or decreased to limit the output load current.

Again, similarly, the reference voltage module 410 is configured to input a reference voltage to the voltage regulator 420. The voltage regulator 420 is configured to output a regulated output voltage. The voltage regulator outputs an output voltage and an output current, wherein the output voltage is based on the input reference voltage. The current sensor and comparator 460 is configured to sense an output current of the voltage regulator 420. The current limitation controller 470 is a controller for limiting the output current. In some embodiments, the current limitation controller 470 is a circuit which acts on the reference voltage input of the voltage regulator 420 to limit the maximum output load current. The current limitation controller 470 is configured to limit the output current of the voltage regulator 420 in response to an output of the current sensor and comparator 460 by adjusting the reference voltage from the reference voltage module 410.

Figure 4B:
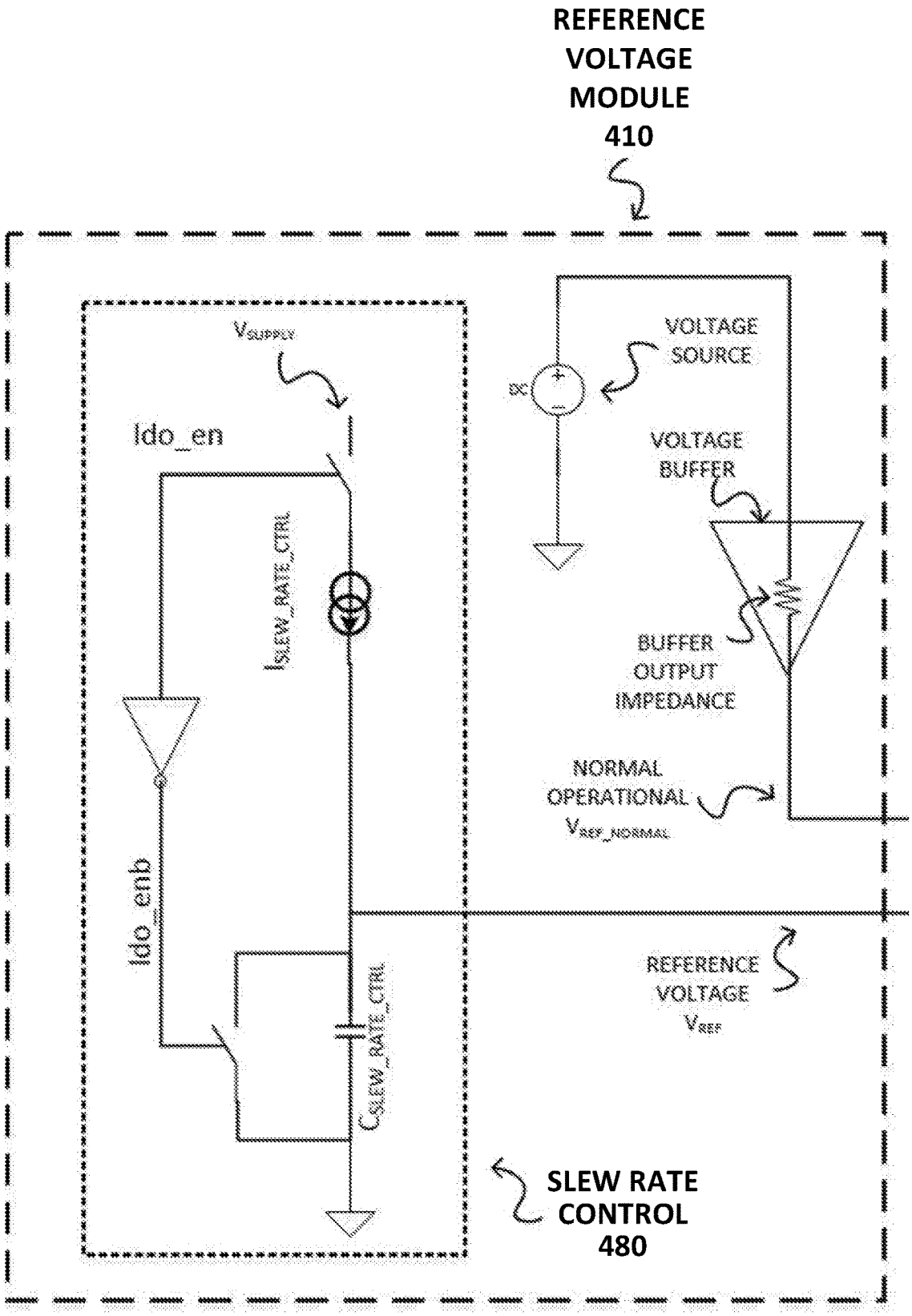
FIG. 4B shows a circuit diagram of a reference voltage module (which includes a slew rate control and is part of the FIG. 4A device) in accordance with some embodiments of the invention.
Figure 4C:
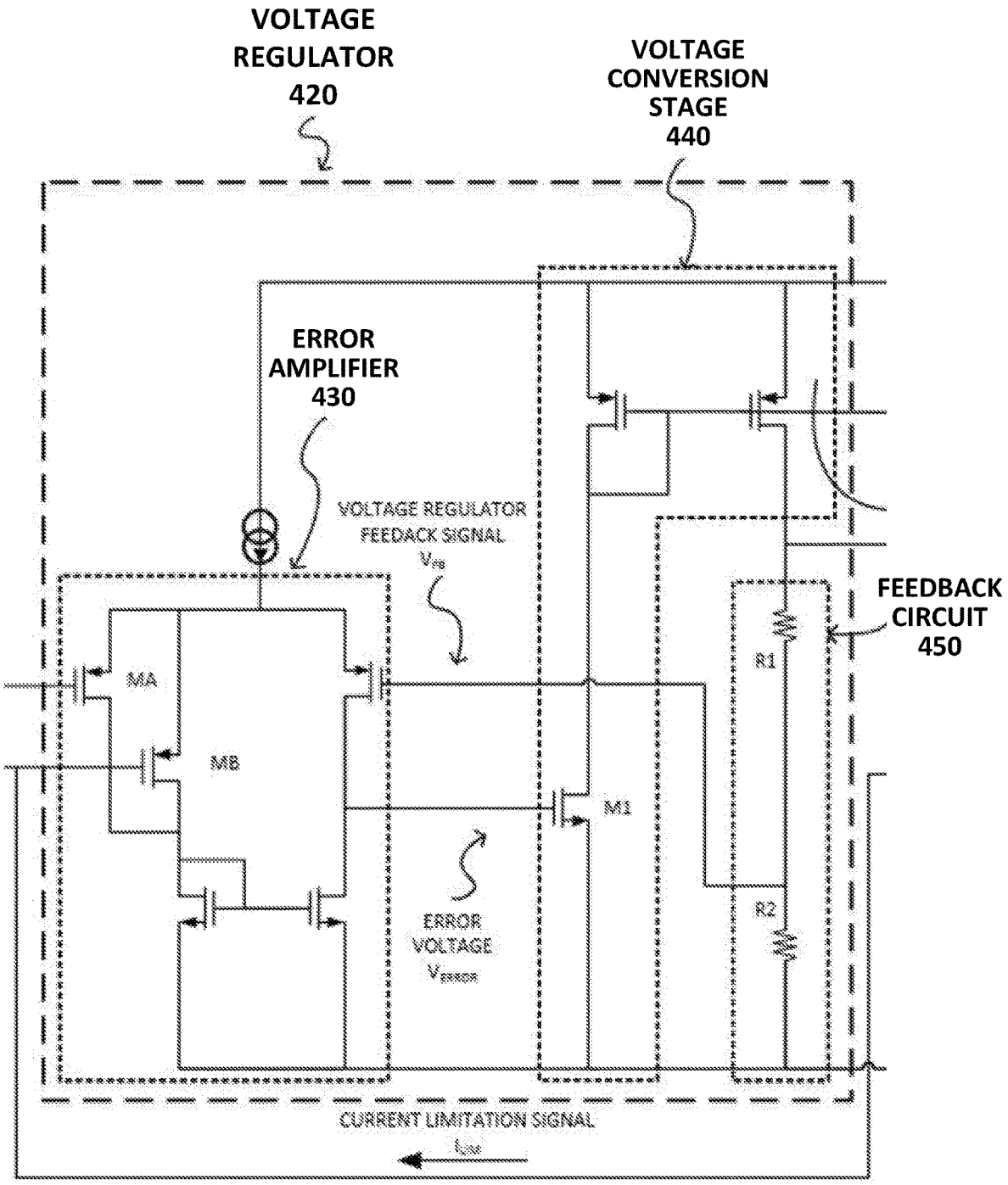
FIG. 4C shows a circuit diagram of a voltage regulator (which is part of the FIG. 4A device) in accordance with some embodiments of the invention.
Figure 4D:
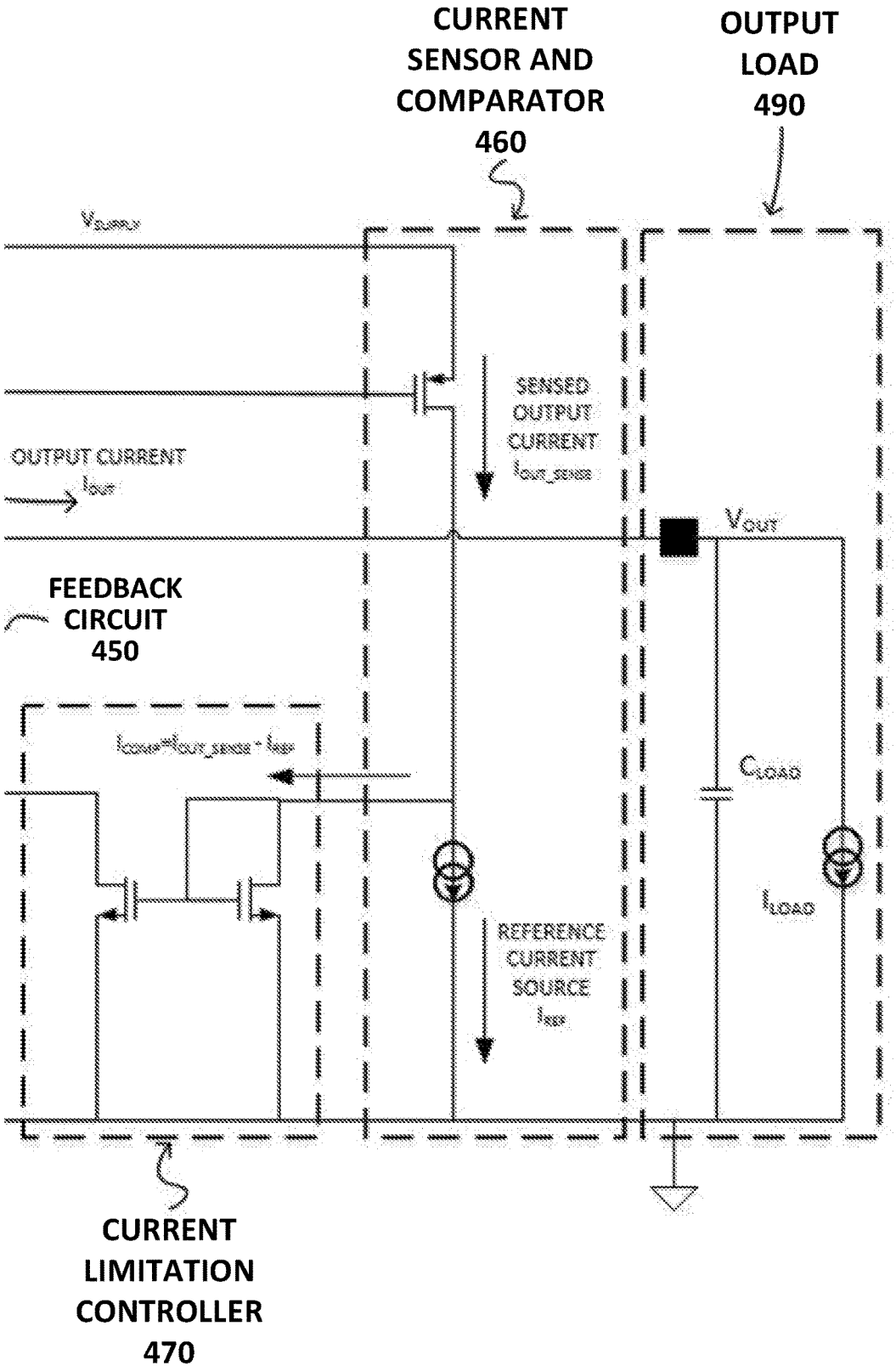
FIG. 4D shows a circuit diagram of a current limitation controller and a current sensor and comparator (which are part of the FIG. 4A device) and an output load in accordance with some embodiments of the invention.

FIG. 4A shows an overview of circuit 400, while FIGS. 4B, 4C, and 4D give the close-up views of various parts of circuit 400. In particular, FIG. 4B is showing the close-up view of the reference voltage module 410 and the slew rate control 480 in accordance with some embodiments of the invention. FIG. 4C is showing the close-up views of the voltage regulator 420 in accordance with some embodiments of the invention. FIG. 4D is showing the close-up views of the current limitation controller 470, the current sensor and comparator 460, and the output load 490 in accordance with some embodiments of the invention.

As shown in FIGS. 4A, 4B, 4C, and 4D: the voltage regulator 420 and the current limitation controller 470 operate similarly to their counterparts in FIGS. 2A, 2B, 2C, and 2D. The difference is that the error amplifier 430 receives 2 voltages (NORMAL OPERATIONAL VREF_NORMAL, from the voltage source and REFERENCE VOLTAGE VREF from the slew rate control circuit), as shown in FIGS. 4A, 4B, and 4C. MA and MB act as a minimum selector. This means that the lowest voltage from the gate voltages of MA (NORMAL OPERATIONAL VREF_NORMAL) and MB (REFERENCE VOLTAGE VREF) will regulate the output voltage VOUT. At the start-up of the voltage regulator, the NORMAL OPERATIONAL VREF_NORMAL may already be present or rises very quickly, this can cause a very high output current IOUT especially when VOUT has been discharged to GND and CLOAD has a high value. To limit IOUT, the slew rate control will generate a slowly increasing reference voltage REFERENCE VOLTAGE VREF matching in speed with VOUT increase rate. This is done by charging the capacitor CSLEW_RATE_CTRL with a current ISLEW_RATE_CTRL, as shown in FIGS. 4A and 4B. The result is a linear voltage slope for REFERENCE VOLTAGE VREF (output of the slew rate control circuit). Such a slope is proportional to the current ISLEW_RATE_CTRL and inversely proportional to the capacitor CSLEW_RATE_CTRL. As long as REFERENCE VOLTAGE VREF is below NORMAL OPERATIONAL VREF_NORMAL, VOUT will follow REFERENCE VOLTAGE VREF. As soon as REFERENCE VOLTAGE VREF exceeds NORMAL OPERATIONAL VREF_NORMAL, the output voltage VOUT is then fixed by the NORMAL OPERATIONAL VREF_NORMAL (MA and MB act as a minimum selector) to the nominal desired voltage value. In case IOUT increases too much during normal operation (i.e. ISENSE_OUT exceeds IREF), ILIM is outputted and decreases REFERENCE VOLTAGE VREF. If REFERENCE VOLTAGE VREF drops below the NORMAL OPERATIONAL VREF_NORMAL, then it will take control of the voltage regulator (MA and MB act as a minimum selector) and limit the output current.

Figure 5:
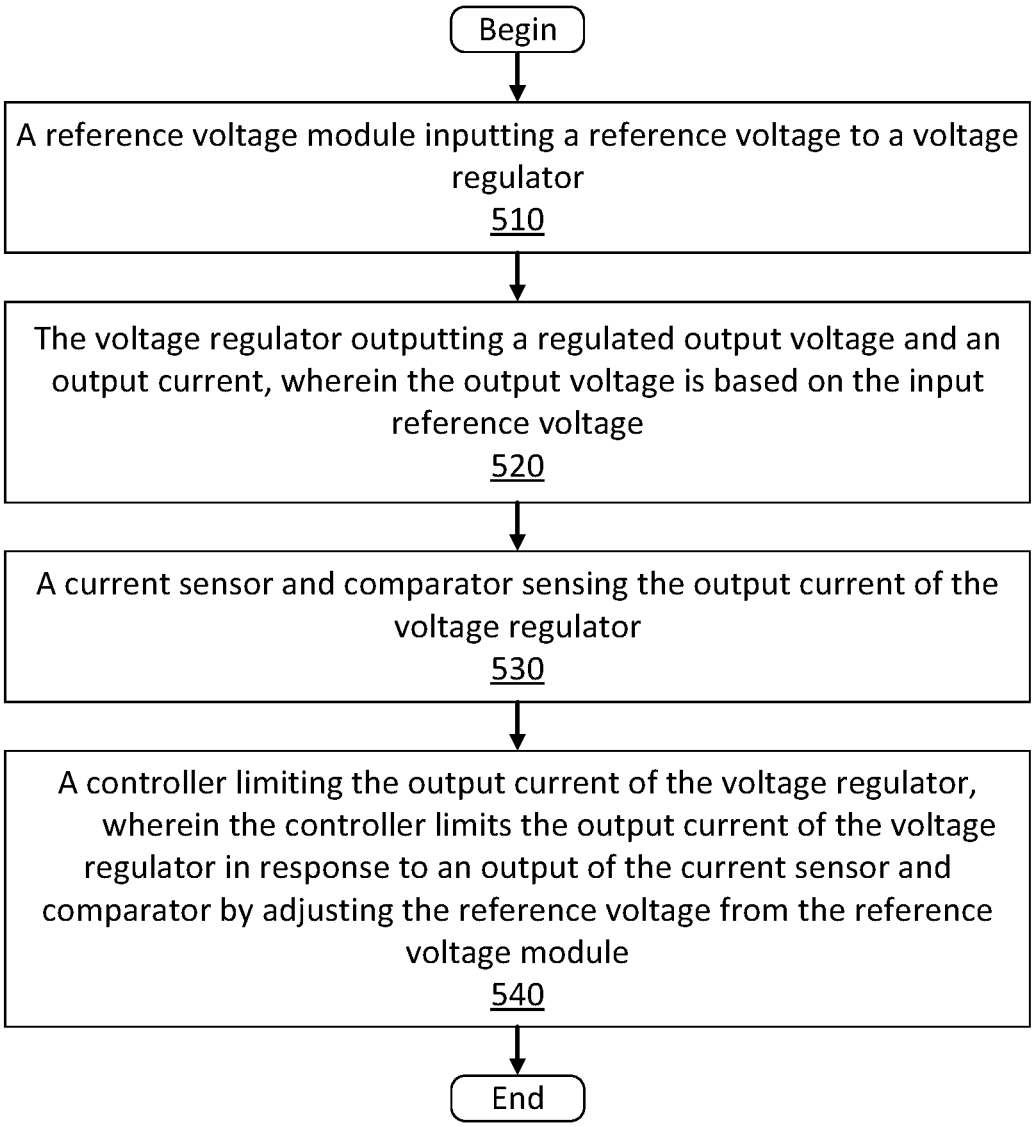
FIG. 5 shows a method for limiting output current of a voltage regulator in accordance with some embodiments of the invention.

FIG. 5 shows a method 500 for limiting output current of a voltage regulator in accordance with some embodiments of the invention. As shown in FIG. 5, the method 500 begins at step 510, where the method begins with a reference voltage module inputting a reference voltage to a voltage regulator. Then, the method proceeds to step 520. In step 520, the method continues with the voltage regulator outputting a regulated output voltage and an output current, wherein the output voltage is based on the input reference voltage. Next, at step 530, the method goes on with a current sensor and comparator sensing the output current of the voltage regulator. Then, the method proceeds to step 540. In step 540, the method continues with a controller limiting the output current of the voltage regulator, wherein the controller limits the output current of the voltage regulator in response to an output of the current sensor and comparator by adjusting the reference voltage from the reference voltage module.

In this specification, example embodiments have been presented in terms of a selected set of details. However, a person of ordinary skill in the art would understand that many other example embodiments may be practiced which include a different selected set of these details. It is intended that the following claims cover all possible example embodiments.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

It should also be noted that at least some of the operations for the methods may be implemented using software instructions stored on a computer useable storage medium for execution by a computer. As an example, an embodiment of a computer program product includes a computer useable storage medium to store a computer readable program that, when executed on a computer, causes the computer to perform operations, as described herein.

The computer-useable or computer-readable medium can be an electronic, magnetic, optical, electromagnetic, infrared, or semiconductor system (or apparatus or device), or a propagation medium. Examples of a computer-readable medium include a semiconductor or solid-state memory, magnetic tape, a removable computer diskette, a random access memory (RAM), a read-only memory (ROM), a rigid magnetic disc, and an optical disc. Examples of optical discs include a compact disc with read only memory (CD-ROM), a compact disc with read/write (CD-R/W), a digital video disc (DVD), and a Blu-ray disc.

The various aspects, embodiments, implementations or features of the described embodiments can be used separately or in any combination. Various aspects of the described embodiments can be implemented by software, hardware or a combination of hardware and software.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

The invention claimed is:

1. A device comprising:

a voltage regulator, the voltage regulator configured to output a regulated output voltage;

a reference voltage module, the reference voltage module configured to output a reference voltage to the voltage regulator;

a current sensor and comparator, the current sensor and comparator configured to sense an output current of the voltage regulator;

a controller for current limitation, the controller having a feedback to the reference voltage module, wherein the controller is configured to limit the output current of the voltage regulator in response to an output of the current sensor and comparator by adjusting the reference voltage from the reference voltage module.

2. The device of claim 1, wherein the current sensor and comparator is further configured to compare the output current of the voltage regulator with a reference current to activate the current limitation.

3. The device of claim 1, wherein the controller is further configured to limit the output current of the voltage regulator in response to the output of the current sensor and comparator indicating an overload by adjusting the reference voltage from the reference voltage module.

4. The device of claim 1 wherein the voltage regulator comprises:

an error amplifier, a voltage conversion stage, a feedback circuit, wherein the error amplifier is configured to receive input from both the reference voltage module and the feedback circuit, and to provide output to the voltage conversion stage, wherein the voltage conversion stage is configured to receive input from the error amplifier and to provide voltage regulator output voltage to the feedback circuit, wherein the current sensor and comparator is further configured to generate a copy of the voltage regulator output current.

5. The device of claim 4, wherein the voltage conversion stage comprises:

an output power stage driven by an output power stage controller.

6. The device of claim 5, wherein the output power stage controller is a linear controller or a switching controller.

7. The device of claim 6, wherein the feedback circuit is a voltage control circuit or a current control circuit.

8. The device of claim 1, wherein the reference voltage module further comprises a slew rate control, wherein the slew rate control is coupled to the voltage regulator, wherein the slew rate control limits an inrush current of the voltage regulator by controlling a slope of variation of an input to the voltage regulator.

9. The device of claim 8, wherein the controller is further configured to limit the output current of the voltage regulator by adjusting an output voltage of the slew rate control.

10. The device of claim 9, wherein the reference voltage module is able to concurrently provide a normal operational reference voltage that is not adjusted by the controller for current limitation to another voltage regulator.

11. A method for limiting output current of a voltage regulator, the method comprising:

a reference voltage module inputting a reference voltage to a voltage regulator;

the voltage regulator outputting a regulated output voltage and an output current, wherein the output voltage is based on the input reference voltage;

a current sensor and comparator sensing the output current of the voltage regulator;

a controller having a feedback to the reference voltage module limiting the output current of the voltage regulator, wherein the controller limits the output current of the voltage regulator in response to an output of the current sensor and comparator by adjusting the reference voltage from the reference voltage module.

12. The method of claim 11 further comprising:

the current sensor and comparator comparing the output current of the voltage regulator with a reference current to activate the output current limitation by the controller.

13. The method of claim 11, wherein the voltage regulator outputting an output voltage and an output current comprises:

an error amplifier receiving input from both the reference voltage module and a feedback circuit, the error amplifier providing output to a voltage conversion stage, the voltage conversion stage providing voltage regulator output voltage to the feedback circuit, the voltage conversion stage providing voltage regulator output current to the current sensor and comparator.

14. The method of claim 11, wherein the reference voltage module further comprises a slew rate control, wherein the slew rate control is coupled to the voltage regulator, wherein the slew rate control limits an inrush current of the voltage regulator by controlling a slope of variation of an input to the voltage regulator.

15. The method of claim 14, wherein the controller further limits the output current of the voltage regulator by adjusting an output voltage of the slew rate control.

* * * * *